US005996795A

United States Patent [19]

Kellar

[11] Patent Number: 5,996,795

[45] Date of Patent: Dec. 7, 1999

[54] PACKAGE FOR HOLDING GOODS

[75] Inventor: David S Kellar, Corvallis, Oreg.

[73] Assignee: Hewlett-Packard Company, Palo Alto, Calif.

[21] Appl. No.: 09/303,159

[22] Filed: Apr. 30, 1999

[51] Int. Cl.[6] ..... B65D 21/00

[52] U.S. Cl. ..... 206/457; 206/503; 229/112; 229/116.1; 220/4.27

[58] Field of Search ..... 206/457, 745, 206/748, 775, 503; 220/4.26, 4.27, 23.83; 229/108, 112, 116.1

[56] References Cited

U.S. PATENT DOCUMENTS

| | | | |
|---|---|---|---|
| D. 224,290 | 7/1972 | Robertson . | |
| D. 227,229 | 6/1973 | Funabashi . | |
| D. 288,533 | 3/1987 | Jialanella et al. . | |
| D. 342,025 | 12/1993 | Abraben et al. . | |
| D. 355,598 | 2/1995 | Aronhalt . | |
| D. 357,626 | 4/1995 | Snow et al. . | |
| D. 368,028 | 3/1996 | Baker . | |
| 2,749,016 | 6/1956 | Cote | 229/112 |
| 3,885,667 | 5/1975 | Spiegel et al. . | |
| 3,904,029 | 9/1975 | Koltz . | |
| 4,203,525 | 5/1980 | Okubo | 220/4.27 X |
| 4,326,546 | 4/1982 | Acker . | |
| 4,630,734 | 12/1986 | Severin et al. . | |
| 4,944,402 | 7/1990 | Wu | 220/4.27 X |
| 5,069,334 | 12/1991 | Herrin et al. . | |
| 5,186,345 | 2/1993 | Ching An . | |
| 5,379,894 | 1/1995 | Hass et al. . | |
| 5,538,179 | 7/1996 | Cai | 206/457 X |
| 5,660,322 | 8/1997 | Jensen . | |

OTHER PUBLICATIONS

Modern Packaging, p. 134 Date: 1972–73.
Packaging, vol. 31 (From 206/470), p. 53 Date: Aug. 1986.
Techform Inc. (From 206/461) Date: Nov. 1982.
Gillette Sensor 5 Cartridges (for a razor) Date: 1989 (c).
Gillette Sensor 15 Cartridges (for a razor) Date: 1989 (c).
Cachet Perfume Date: not known.
Chocolate Fudge Date: not known.
Modern Packaging Catalog, p. 318 Date: 1967.
Modern Packaging, p. 311 Tapered edge Package Date: 1961.
Hewlett–Packard HP51629A Black Inkjet Print Cartridge Packaging Date: Unknown.
Hewlett–Packard C1809A Design Jet CP Ink System Packaging Date: Unknown.
U.S. Design Patent application entitled "Packaging Carton" serial No. 29/060,800 filed Oct. 07, 1996 by Kellar, etal.

*Primary Examiner*—Jacob K. Ackun
*Attorney, Agent, or Firm*—Edward Maker II

[57] ABSTRACT

A set of tiered trapezoidal cartons bundled together for holding goods. Each carton has a generally trapezoidal profile and the set of cartons stacks together to have a generally trapezoidal combined profile.

12 Claims, 7 Drawing Sheets

PACKAGE FOR HOLDING GOODS

FIELD OF INVENTION

The present invention generally relates to carriers for goods and, more particularly, to packages and package designs.

BACKGROUND OF THE INVENTION

Packaging for manufactured goods serves multiple purposes including creating a sufficiently favorable impression in the customer to influence the selection of the goods for purchase, protecting the goods from damage during transit, identifying the manufacturer, and conveying a message from the manufacturer. In today's market place, and especially in retail sales where a plurality of choices exist, packaging takes on major importance because the purchase decision is often based solely on the packaging.

The first problem with contemporary packaging, and probably the most significant, is how to fulfill all of the various purposes for packaging while maintaining the flexibility to make last minute changes in the package design, keeping the cost of the packaging as low as possible, and sustaining a uniform but distinctive packaging appearance for products of different shapes and sizes.

It is apparent that although there are a myriad of packaging shapes, colors, and materials, there is still a need for an approach that satisfactorily meets the needs of a product manufacturer in a competitive market place.

SUMMARY OF THE INVENTION

Briefly and in general terms, the invention contemplates a package for holding goods that includes a first container having a generally trapezoidal profile, a second container likewise having a generally trapezoidal profile, and means for bonding the containers together. The containers are dimensioned so that when bonded together, they have a generally trapezoidal combined profile.

This packaging has the advantage of maintaining a distinctive shape for customer brand recognition across broad product lines while being scalable in all dimensions to accommodate manufactured goods of different sizes. The distinctive shape is that of a six sided trapezoid and the process for scaling the design is described below.

Design flexibility is achieved by incorporating an adhesive backed, opaque label. Such a label can be easily changed in the last minute and will obscure any message or design printed on the containers that is no longer desired by the manufacturer.

Other aspects and advantages of the invention will become apparent from the following detailed description, taken in conjunction with the accompanying drawings, illustrating by way of example the principles of the invention.

DESCRIPTION OF THE PREFERRED EMBODIMENTS

Figure 1:
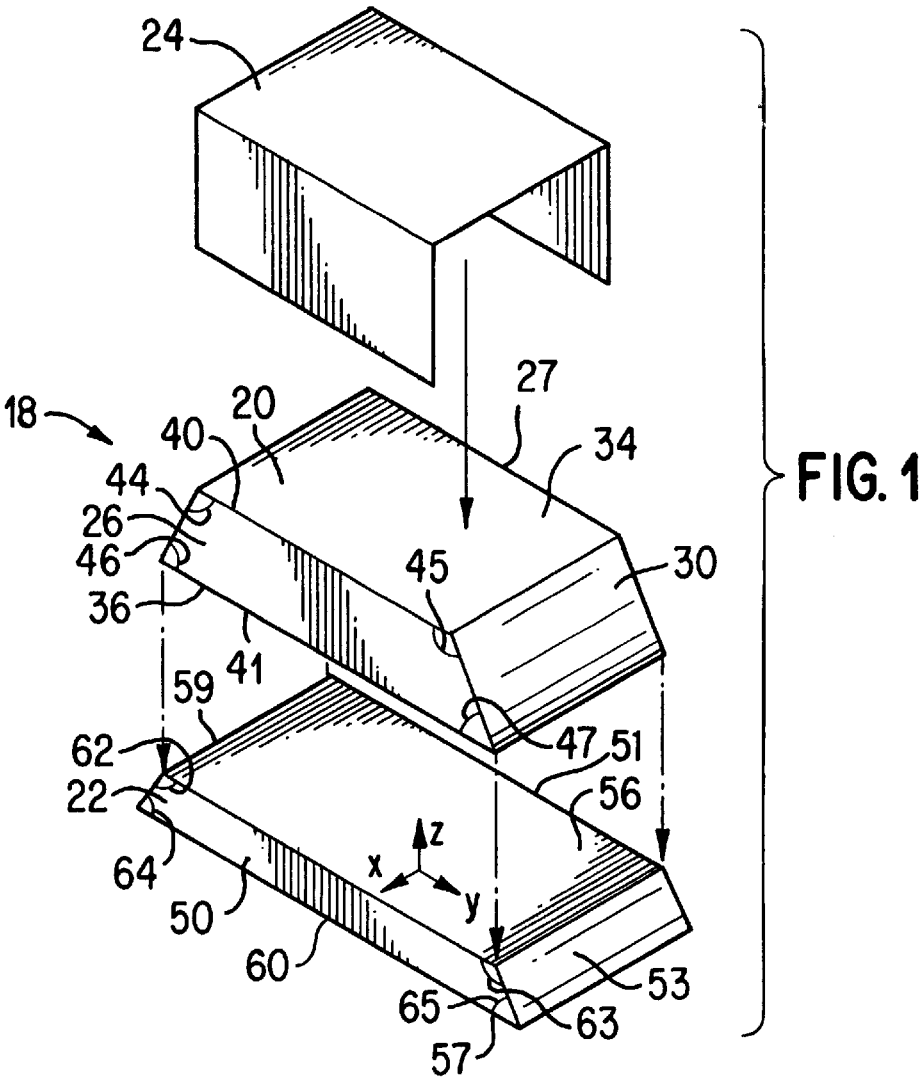
FIG. 1 is an exploded view, in perspective, of a package embodying the principles of the invention.

As shown in the drawings for the purposes of illustration, the invention is embodied in a package for holding goods having a generally trapezoidal profile.

Referring to FIGS. 1–6, reference numeral 18 generally indicates a package comprising a first container 20, a second container 22 and an adhesive backed panel 24. The first container 20 overlies the second container 22 and both are adhesively bonded together by the panel 24 to form a unitary package that will not separate under normal conditions. The containers are fabricated from either paper board or corrugated paper although any substantially rigid packaging material can be used including plastic, wood, and Styrofoam. In the preferred embodiment that was actually fabricated, the material used was F-flute litho.-laminated corrugated paper.

The first container 20 in FIGS. 1–6 includes a side wall 26, a side wall 27, an end wall 30, an end wall 31, a top wall 34 and a bottom wall 36. The two side walls 26, 27 are spaced apart and co-planer and the top and bottom walls 34, 36 are as well. The end walls 30, 31 and the top and bottom walls 34, 36 are rectangular in shape; each verge is parallel with its opposite counter-part and the interior angles of each rectangle are about 90°. The side walls 26, 27 are trapezoidal in shape; that is, each trapezoidal figure has two parallel verges 40, 41 of different lengths. The upper verge 40 is shorter than the lower verge 41. Because the trapezoidal shape of the sidewalls in FIGS. 1–6 is regular, the opposite interior angles are equal. In other words, opposite interior angles 44, 45 and opposite interior angles 46, 47 are equal. In the preferred embodiment that was actually fabricated, the interior angles 46 and 47 were each about 60° and interior angles 44 and 45 were each about 120°.

Referring to FIGS. 1–6, reference numeral 22 generally indicates an underlying second container. The second container includes a side wall 50, a side wall 51, an end wall 53, an end wall 54, a top wall 56, a bottom wall 57, a shorter parallel verge 59, a longer parallel verge 60, and four interior angles 62–65, inclusive. The second container 22 has the same basic trapezoidal shape, the same arrangement of walls, and is fabricated from the same materials as the first container 20 described in detail above. For brevity the features common to both containers will not be repeated.

Figure 2:
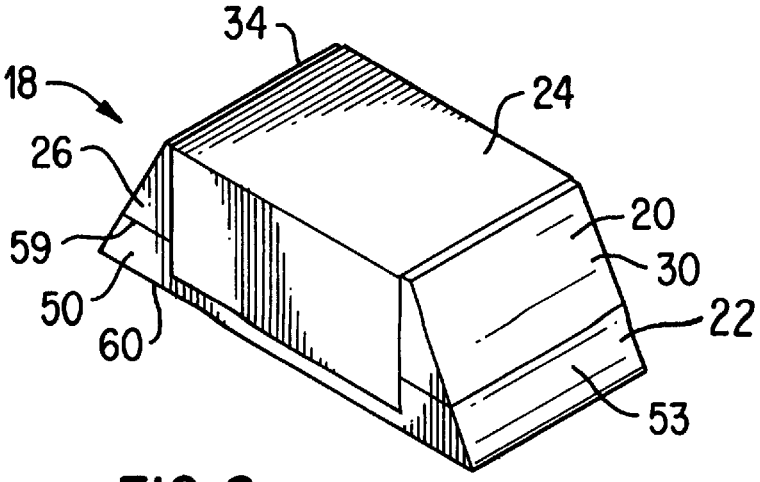
FIG. 2 is a perspective view of the package of FIG. 1.
Figure 3:
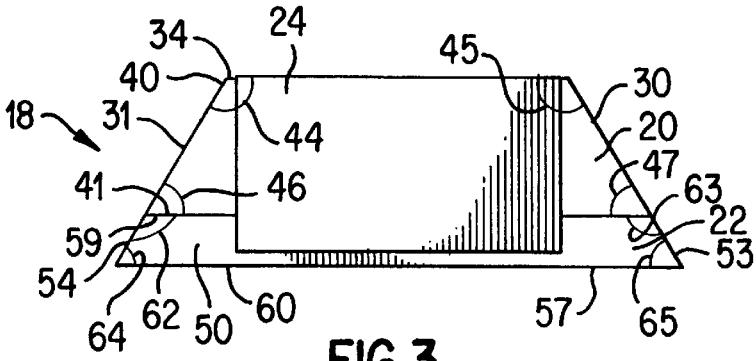
FIG. 3 is a side view, in elevation, of the package of FIG. 1.
Figure 4:
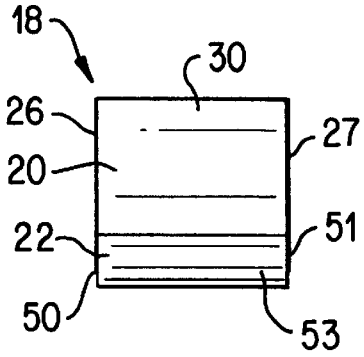
FIG. 4 is an end view, in elevation, of the package of FIG. 1.
Figure 5:
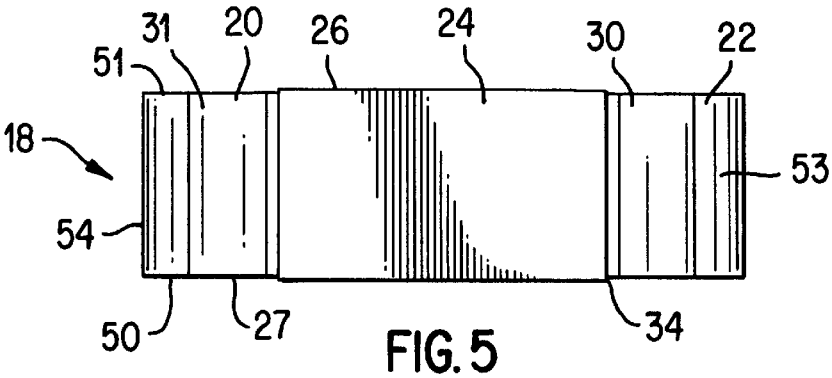
FIG. 5 is a top plan view of the package of FIG. 1.
Figure 6:
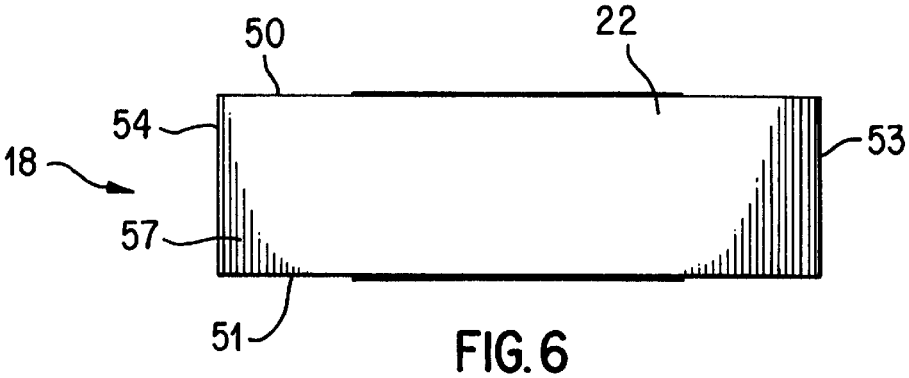
FIG. 6 is a bottom plan view of the package of FIG. 1.

Referring to FIGS. 1 and 2, the two containers come together one on top of the other and, when so combined, have a generally trapezoidal profile. This feature is achieved by dimensioning the width of the first container 20, (the distance along the X axis) to be the same as the width of the second container 22. In addition, the length of the longer parallel verge 41 of the sidewall 26, 27 of the first container 20 is equal to the length of the shorter parallel verge 59 of the sidewall 50, 51 of the second container 22 and the corresponding opposite interior angles on the sidewalls of both containers are equal. In other words, angles 44, 45 are equal to angles 62, 63 and angles 46, 47 are equal to angles 64, 65. In the preferred embodiment actually fabricated, the angles 44, 45, 62, and 63 were all about 60° and angles 46, 47, 64, and 65 were all about 120°.

The height of the first container 20 (the distance along the Z axis) is greater than the height of the second container 22. These heights are a matter of design choice and can be equal or greater or lesser than each other depending on the size and shape of the goods being packaged.

Referring to FIG. 1, the panel 24 is an inelastic, deformable member that adhesively bonds the four sidewalls 26, 27, 50 and 51 of the two containers 20, 22 together into one unitary package. The interior face of the panel is coated with a not-easily-removable adhesive. In the embodiment that was actually fabricated, the panel was a printed label similar to those labels widely used for addressing packages. It is also contemplated within the scope of this invention to bond the containers together by gluing the bottom wall 36 of the first container 20 to the top wall 56 of the second container. In either case, access to the goods within the package 18 is obtained through the end walls 30, 31, 53, and 54.

Figure 7:
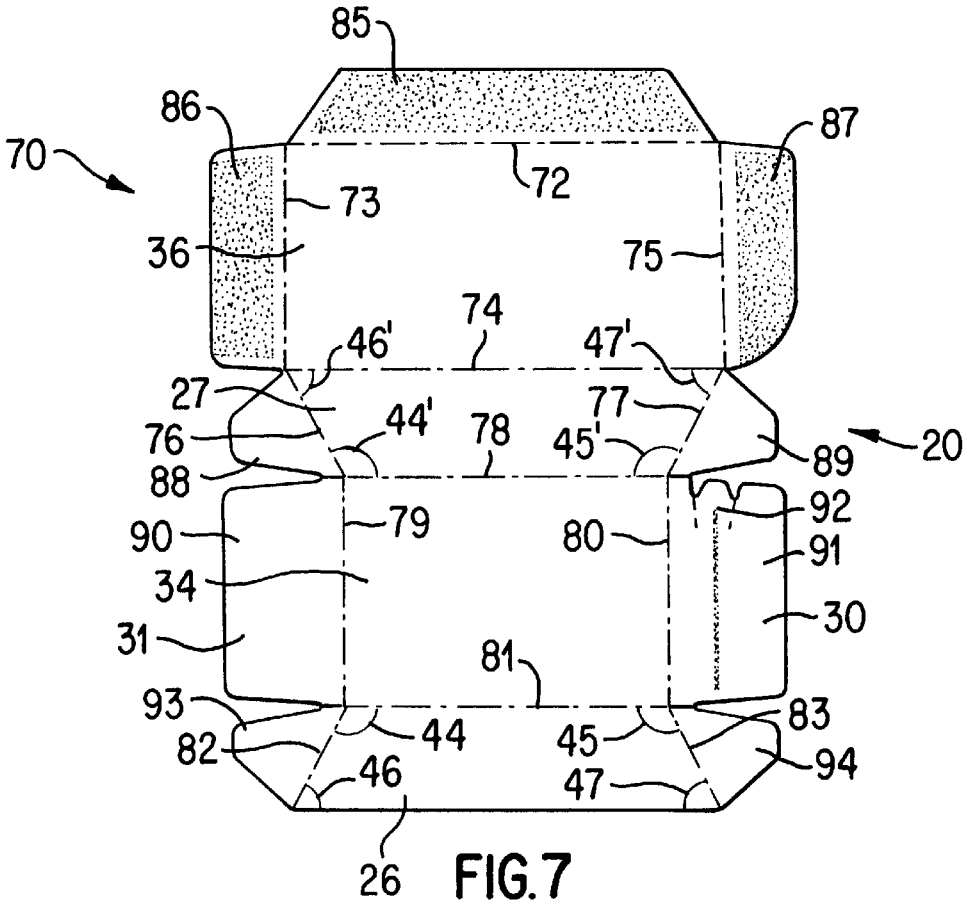
FIG. 7 is a illustration of the pattern from which the upper container of the package of FIG. 1 is fabricated.

Reference numeral 70, FIG. 7 generally indicates the pattern from which the first container 20 is fabricated. The bottom wall 36 is defined by the score lines 72, 73, 74 and 75; the side wall 27 by score lines 74, 76, 77, and 78; the top wall 34 by score lines 78, 79, 80 and 81; and the side wall 26 by score lines 81, 82, 83. The score line 72 also defines a manufacturing joint 85 and likewise score lines 73 and 75 define two inner major flaps 86 and 87. The manufacturing joint 85 and the inner major flaps 86, 87 are stippled in FIG. 7 to indicate that adhesive is placed on these areas during assembly of the container. Score lines 76 and 77 define two minor flaps 88 and 89, and score lines 79 and 80 define two outer major flaps 90 and 91. Reference numeral 92 generally indicates a tear strip that provides access to the goods in the container after the container is assembled and filled. The two minor flaps 93 and 94 are formed by the score lines 82 and 83. As mentioned above, opposite interior angels 46 and 47 are each about 60° and opposite internal angles 44 and 45 are each about 120°.

Figure 8:
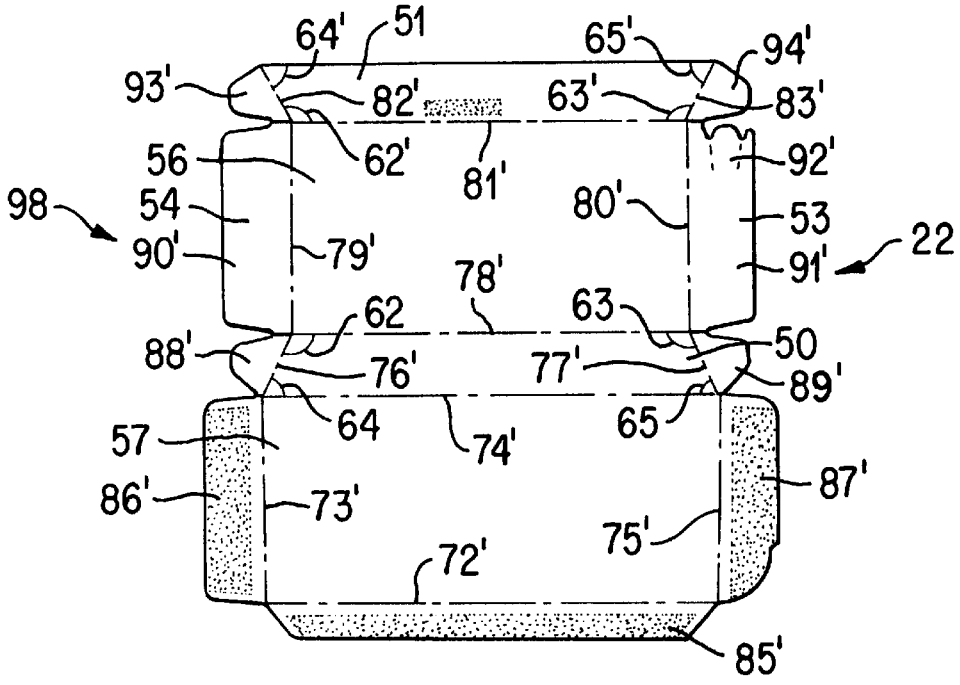
FIG. 8 is a illustration of the pattern from which the lower container of the package of FIG. 1 is fabricated.
Figure 9:
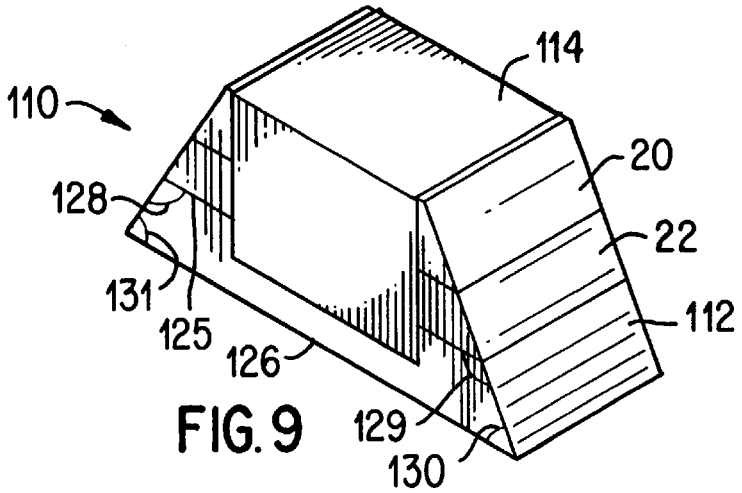
FIG. 9 is perspective view of an alternative embodiment of a package embodying the principles of the invention.
Figure 10:
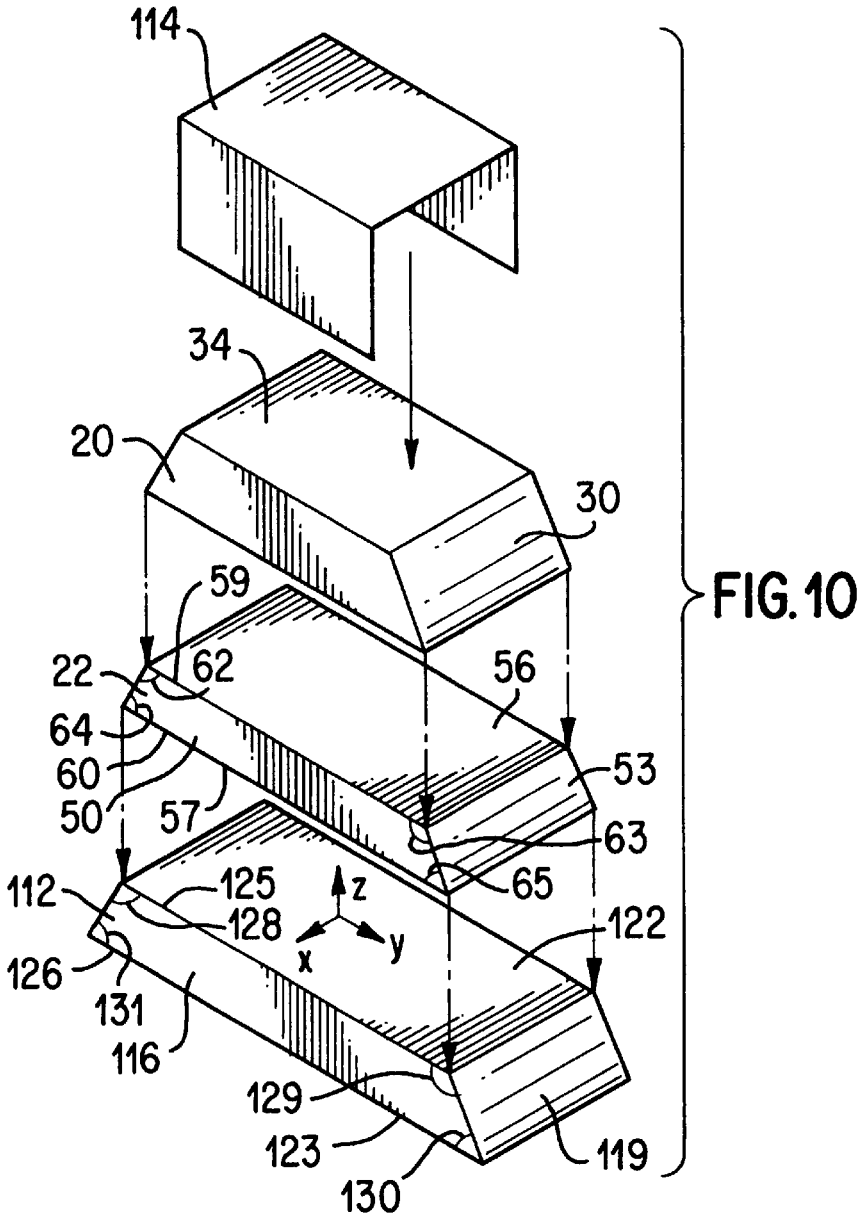
FIG. 10 is an exploded view, in perspective, of the package of FIG. 9.
Figure 11:
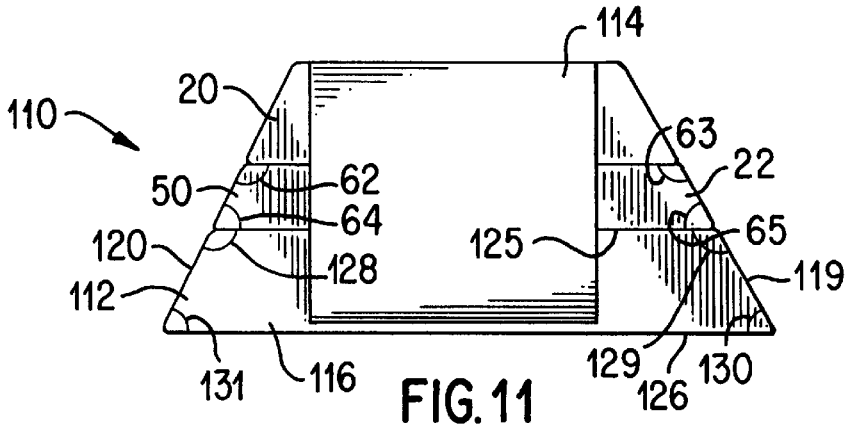
FIG. 11 is a side elevational view of the package of FIG. 9.
Figure 12:
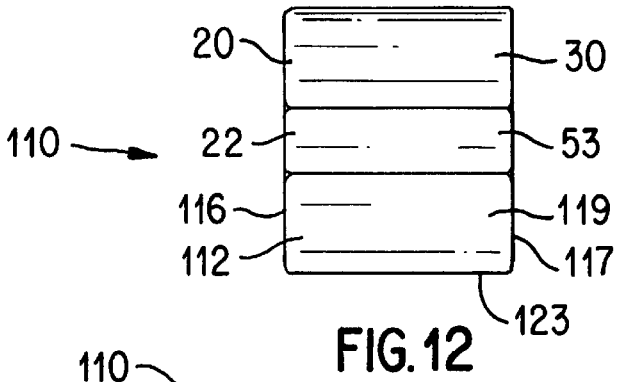
FIG. 12 is an end elevational view of the package of FIG. 9.
Figure 13:
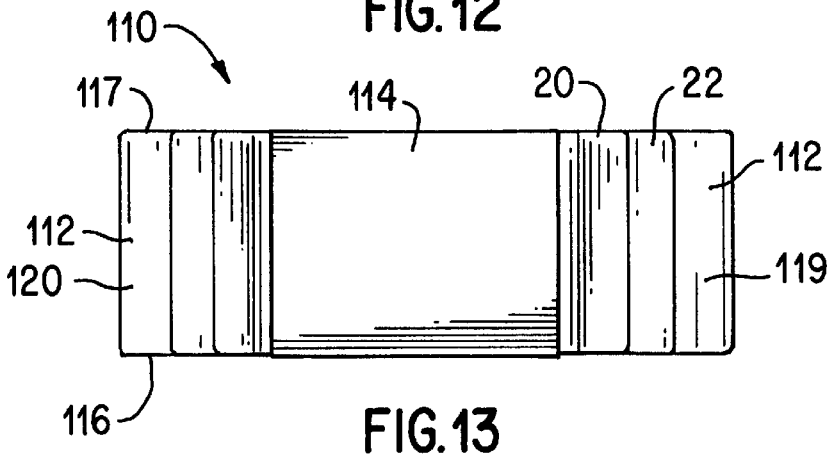
FIG. 13 is a top plan view of the package of FIG. 9.
Figure 14:
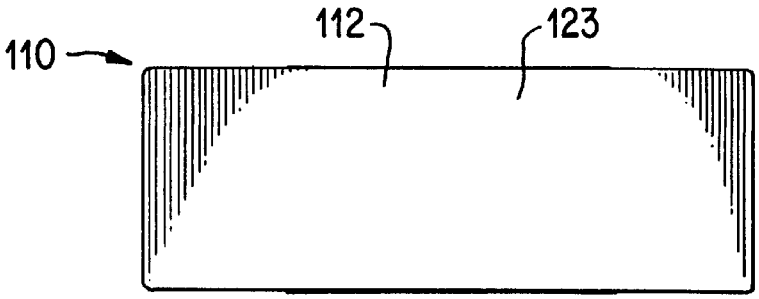
FIG. 14 is a bottom plan view of the package of FIG. 9.

The pattern for the second container 22 is illustrated in FIG. 8 and generally indicated by reference numeral 98. The pattern 70 for the first container 20, FIG. 7, differs from the pattern 98 of the second container 22, FIG. 8, in several ways: one pattern is illustrated as being rotated about 180° with respect to the other, the length of the walls 26, 27, 34, and 36 (as best seen in FIG. 1) of the first container are shorter than the walls 50, 51, 56, and 57 (as best seen in FIG. 1) of the second container as measured along the Y axis in FIG. 1, and the height of the side walls 26 and 27 (as best seen in FIG. 1) differ from the side walls 50, 51 (as best seen in FIG. 1) as measured along the Z axis in FIG. 1. To obtain the combined profile of a trapezoid when the two trapezoid containers are stacked, the angles 44, 45, 46, and 47 in pattern 70 are the same as the corresponding angles 62, 63, 64, and 65 in pattern 98. The shapes of the minor flaps 88, 89, 93, and 94 in pattern 70 are proportionally scaled up in to the minor flaps 88', 89', 93', and 94' of pattern 98.

To assemble the first container 20, the material from which the container is to be fabricated is cut and scored following the pattern 70 illustrated in FIG. 7. Next, either glue or adhesive is applied to the manufacturing joint 85 and the joint is bonded to the side wall 26. After glue setting, the container is folded open along the score lines 72, 74, 78, and 81 so that in the plane formed by the X and Z axes, FIG. 1, the walls 26, 27, 34, and 36 form a rectangle. At this point the goods can be loaded into the partially formed container. Thereafter, the minor flaps 88, 89, 93, and 94 are folded in. Next, glue is placed on the surface of the inner major flaps 86, 87, they are folded inward, and the outer major flaps 90, 91 are folded on top of the inner major flaps. The glue is allowed to set and the first container is formed. In this embodiment the minor flaps 88, 89, 93 and 94 need not be bonded to any of the walls.

The second container 22 is formed in the same manner from the pattern 98 illustrated in FIG. 8 and for brevity will not be described.

Referring to FIGS. 9–14, reference numeral 110 generally indicates a package that includes the first container 20, the second container 22, and a third container 112. The three containers are joined by an adhesive backed, deformable, in-elastic panel 114. The first and second containers 20, 22, overlie the third container 112 and all are adhesively bonded together by the panel 114 to form a unitary package. The adhesive panel 114 is constructed and functions in the same manner as the adhesive panel 24, FIG. 1.

The third container 112 includes two side walls 116, 117, two end walls 119, 120, a top wall 122, and a bottom wall 123. The side walls 116, 117, are trapezoidal in shape; that is, each trapezoidal figure has two parallel verges 125, 126 of different lengths. The upper verge 125 is shorter in length than the lower verge 126. The third container has the same shape and profile as the two previously described containers 20, 22. To achieve this result, the corresponding interior angles of all of the side walls 26, 27, 50, 51, 116, and 117 are the same. In other words, interior angles 46, 47, 64, 65, 130, and 131 are equal and in the preferred embodiment are each about 60°. Likewise, interior angles 44, 45, 62, 63, 64, and 65 are equal and are each about 120°.

The three containers come together in the package 110 one on top of the other so that when all are combined, the package has a generally trapezoidal combined profile. This feature is achieved in the same manner as for the package 18, FIG. 2. The width of the third container 112 (the distance along the X axis) is equal to the width of the over lying two containers 20, 22. Further, the length of the longer parallel verge 60 of the side walls 50, 51 of the second container 22 is equal to the length of the shorter parallel verge 125 of the side walls 116, 117 of the third container 112. In addition, the corresponding opposite interior angles on the sidewalls of all of the containers are equal.

Figure 15:
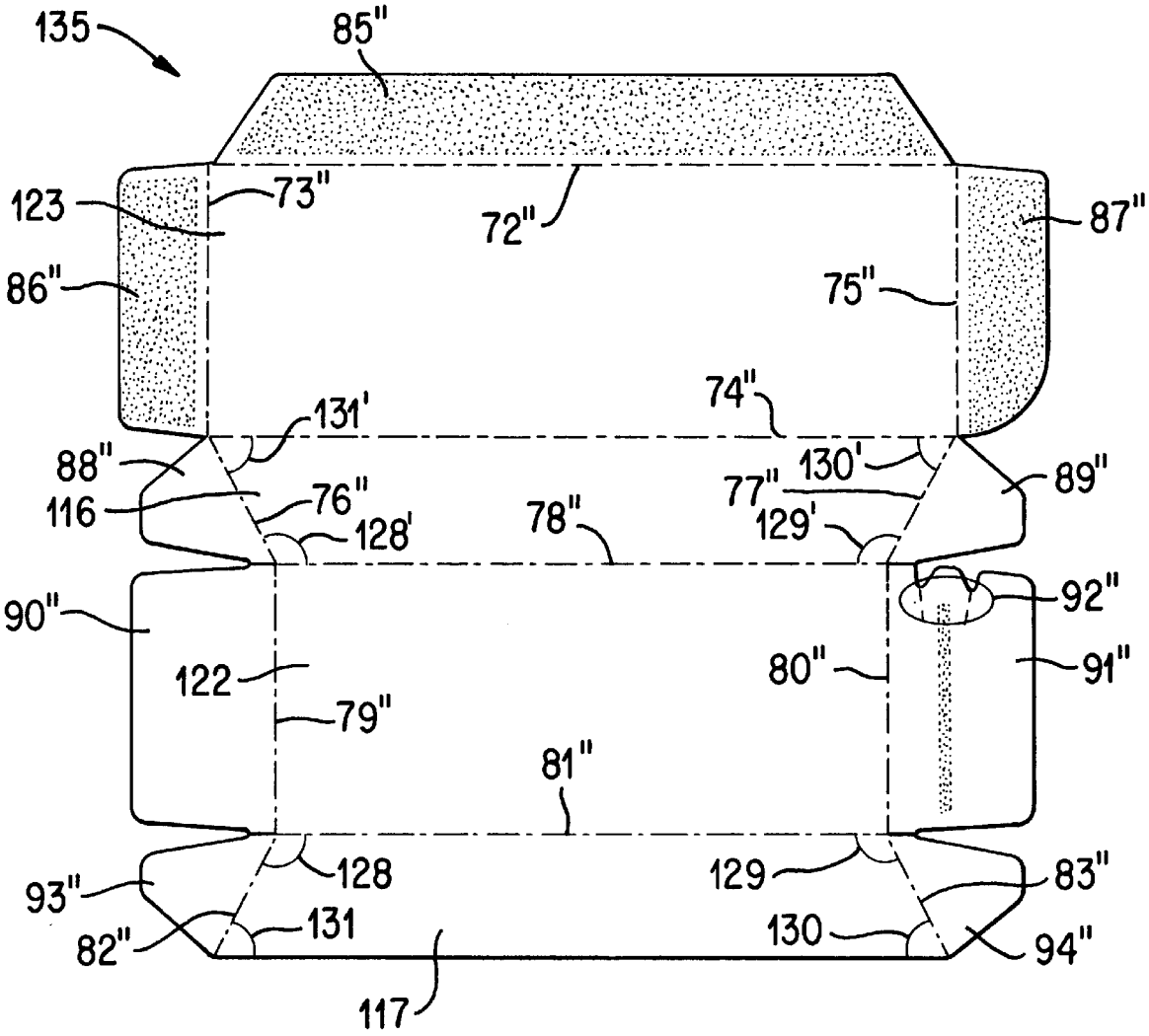
FIG. 15 is a illustration of the pattern from which the lower container of the package of FIG. 9 is fabricated.

Reference numeral 135, FIG. 15 generally indicates the pattern from which the third container 112 is fabricated. The walls, score lines, and flaps in this pattern 135 are defined and function in the same manner as described with respect to the patterns 70 and 98. The pattern 112 is also scaled up from the patterns 70 and 98 in the same manner.

Figure 16:
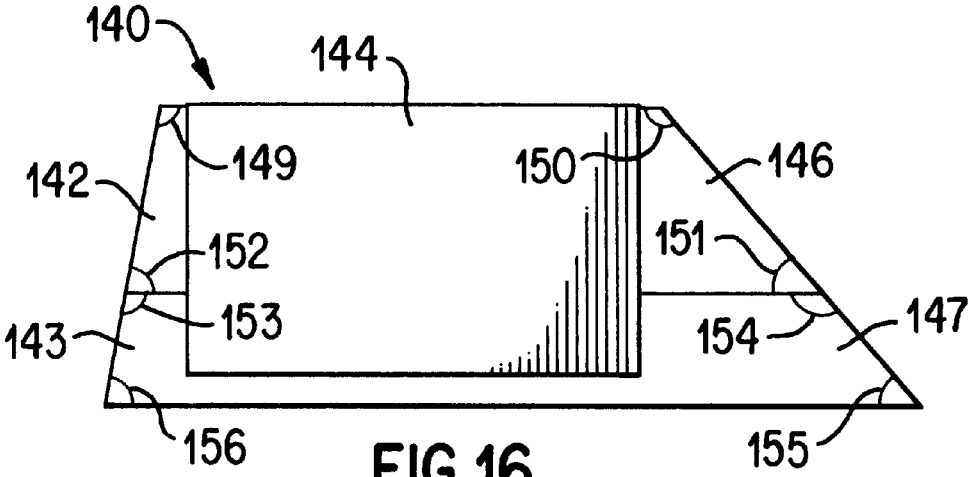
FIG. 16 is a side elevational view of a second alternative embodiment of a package embodying the principles of the invention.

Referring to FIG. 16, reference numeral 140 generally indicates an alternative embodiment of the package. This package comprises a first container 142 and a second container 143 that are bonded together with an adhesive panel 144. The first container includes a side wall 146 and a second side wall 147. Each of the two side walls, as illustrated in FIG. 16, has the geometrical shape of a trapezoid but is not a regular trapezoid like all of the side walls described heretofore. Each side wall 146, 147 has two parallel, opposite verges but the corresponding, opposite, interior angles in each trapezoidal side wall are not equal. In particular, interior angle 149 is not equal to interior angle 150 and likewise angle 151 does not equal to angle 152. Each angle 149, 150, 151, and 152 in the trapezoidal side wall 146 has a different magnitude. Each angle 153, 154, 155, and 156 in the trapezoidal side wall 147 also has a different magnitude. However, in order to have the two containers combine together in a common trapezoidal profile, each of the corresponding angles in the two containers are equal. In other words, interior angle 149 is equal to interior angle 153; interior angle 150 is equal to interior angle 154; angle 152, to angle 156; and angle 151, to angle 155.

Figure 17:
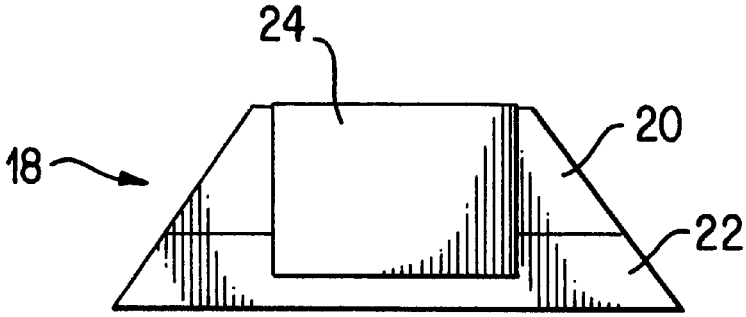
FIG. 17 is a side view, in elevation, of the package of FIG. 1.
Figure 18:
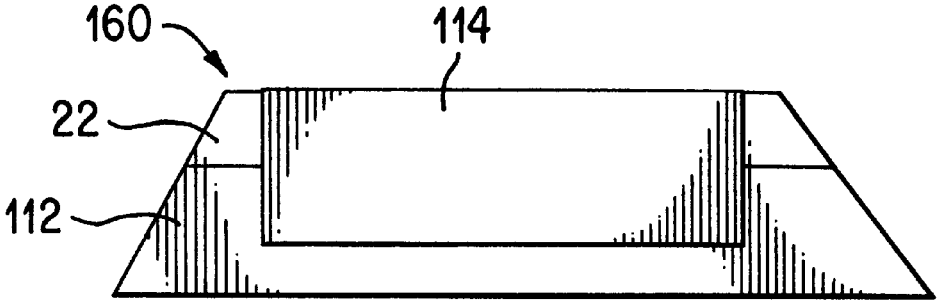
FIG. 18 is a side view, in elevation, of a package including one of the containers of FIG. 17.

FIGS. 17 and 18 illustrate two packages 18 and 160 that were actually fabricated and marketed. Package 18 includes the first container 20 and the second container 22, and package 160 includes the second container 22 and the third container 112. In these two embodiments the second container 22 is common to both packages while both packages maintain the characteristic trapezoidal profile for market brand identification of their common origin.

In the actually fabricated packages, a container of consumable fluid was placed in container 20 and replacement mechanical parts were placed in container 22. A larger container of consumable fluid was placed in container 112 and the same parts were placed in container 22 bonded to it. The two packages were marketed by the same manufacturer for the maintenance of different products that each required the common parts in container 22.

Although specific embodiments of the invention have been described and illustrated, the invention is not to be limited to the specific forms or arrangement of parts so described and illustrated. The invention is limited only by the claims.

I claim:

1. A package for holding goods, comprising:

a) a first container having a generally trapezoidal profile;

b) a second container likewise having a generally trapezoidal profile; and c) means, connected to the first and second containers, for bonding said first and second containers together, said containers being dimensioned such that when bonded together said containers together have a generally trapezoidal combined profile.

2. The package of claim 1 further including a) a third container having a generally trapezoidal profile; and b) means, connected to the second and third containers, for bonding said second and third containers together, said first, second, and third containers being dimensioned such that when bonded together, said three containers together have a generally trapezoidal combined profile.

3. The package of claim 1 wherein the first and second containers have abutting sidewalls and wherein the bonding means is an adhesively backed panel that bonds to said sidewalls.

4. The package of claim 3 wherein each container has two, flat, parallel sidewalls and the two sidewalls on the first container are co-planer and abut with the two sidewalls on the second container and wherein the adhesive panel simultaneously bonds to the four sidewalls of the two containers.

5. A package for holding goods, comprising:

a) a first container having a generally trapezoidal profile;

b) a second container having a generally trapezoidal profile;

c) a third container having a generally trapezoidal profile; and d) means, connected to either the first and second containers or the second and third containers, for bonding together either said first and second containers or said second and third containers so that the package includes the second container bonded to either the first or the third container.

6. The package of claim 5 wherein the first container is substantially smaller in volume than the third container and the package of containers bonded together has a generally trapezoidal profile.

7. A package for holding goods, comprising:

a) a first container having a top wall, a bottom wall, two end walls, and two side walls, said two side walls each having the geometrical shape of a trapezoid with two parallel verges, one verge being shorter and the other verge being longer in length than the other, and said top, bottom, and end walls each having the geometrical shape of a rectangle with two sets of two parallel verges and interior angles of about 90°;

b) a second container having a top wall, a bottom wall, two end walls, and two side walls, said two side walls each having the geometrical shape of a trapezoid with two parallel verges, one verge being shorter and the other verge being longer in length than the other, and said top, bottom, and end walls each having the geometrical shape of a rectangle with two sets of two parallel verges and interior angles of about 90°, the shorter, parallel verge of each of the sidewalls of the second container being substantially equal in length to the longer, parallel verge of each of the sidewalls of the first container so that the first container stacks on top of the second container forming a generally trapezoidal combined profile; and c) means, connected to the first and second containers, for bonding said first and second containers together, said containers being dimensioned such that when bonded together, said containers together have a generally trapezoidal combined profile.

8. The package of claim 7 further comprising:

a) a third container having a top wall, a bottom wall, two end walls, and two side walls, said two side walls each having the geometrical shape of a trapezoid with two parallel verges, one verge being shorter and the other verge being longer in length than the other, and said top, bottom, and end walls each having the geometrical shape of a rectangle with two sets of two parallel verges and interior angles of about 90°, the shorter, parallel verge of each of the sidewalls of the third container being substantially equal in length to the longer, parallel verge of each of the sidewalls of the second container so that the first and second containers stack on top of the third container forming a generally trapezoidal combined profile; and b) means, connected to the second and third containers, for bonding said second and third containers together, said first, second, and third containers being dimensioned such that when bonded together, said three containers together have a generally trapezoidal combined profile.

9. The package of claim 7 wherein the side walls of the first and second containers have the geometrical shape of a regular trapezoid with two parallel verges of different lengths and equal opposite interior angles.

10. The package of claim 7 wherein the side walls of the first and second containers have the geometrical shape of a trapezoid with two parallel verges of different lengths and unequal opposite interior angles.

11. The package of claim 7 wherein the parallel verges of the side walls of the first container are spaced apart a distance D1, the parallel verges of the side walls of the second container are spaced apart a distance D2, and D1 does not equal D2.

12. The package of claim 7 wherein the parallel verges of the side walls of the first container are spaced apart a distance D1, the parallel verges of the side walls of the second container are spaced apart a distance D2, and D1 does equal D2.

* * * * *